US005659149A

United States Patent [19]

Sutula, Jr.

[11] Patent Number: 5,659,149

[45] Date of Patent: Aug. 19, 1997

[54] SECURE CONNECTOR FOR BLAST INITIATION SIGNAL TRANSFER

[75] Inventor: Daniel P. Sutula, Jr., Farmington, Conn.

[73] Assignee: The Ensign-Bickford Company, Simsbury, Conn.

[21] Appl. No.: 576,004

[22] Filed: Jan. 18, 1996

[51] Int. Cl.[6] ..... C06C 5/06

[52] U.S. Cl. ..... 102/275.7; 102/275.12; 102/275.4

[58] Field of Search ..... 102/275.2–275.7, 102/275.11, 275.12

[56] References Cited

U.S. PATENT DOCUMENTS

| | | | |
|---|---|---|---|
| 910,722 | 1/1909 | Purcell | 102/322 |
| 1,097,442 | 5/1914 | Jones | 102/322 |
| 2,923,239 | 7/1960 | Andrew et al. | 102/275.4 |
| 2,952,206 | 9/1960 | Becksted | 102/275.7 |
| 3,175,491 | 3/1965 | Robertson | 102/275.7 |
| 3,285,176 | 11/1966 | Kent | 102/202 |
| 3,296,968 | 1/1967 | Shulman et al. | 102/204 |
| 3,669,021 | 6/1972 | Spencer et al. | 102/275.7 |
| 3,878,785 | 4/1975 | Lundborg | 102/275.4 |
| 4,187,780 | 2/1980 | Petruccelli | 102/275.12 |
| 4,248,152 | 2/1981 | Yunan | 102/275.4 |
| 4,299,167 | 11/1981 | Bryan | 102/202.3 |
| 4,350,097 | 9/1982 | Bowman et al. | 102/275.2 |
| 4,424,747 | 1/1984 | Yunan | 102/275.2 |
| 4,426,933 | 1/1984 | Yunan | 102/275.3 |
| 4,481,884 | 11/1984 | Yunan | 102/313 |
| 4,495,867 | 1/1985 | Mitchell, Jr. et al. | 102/275.4 |
| 4,539,909 | 9/1985 | Day et al. | 102/275.2 |
| 4,714,017 | 12/1987 | Kelly et al. | 102/275.3 |
| 4,714,018 | 12/1987 | Lofgren | 102/275.7 |
| 4,722,279 | 2/1988 | Yunan | 102/275.4 |
| 4,730,560 | 3/1988 | Bartholomew et al. | 102/275.3 |
| 4,815,382 | 3/1989 | Yunan | 102/275.7 |
| 4,821,645 | 4/1989 | Reiss | 102/275.7 |
| 5,069,131 | 12/1991 | Kennedy et al. | 102/275.6 |
| 5,162,606 | 11/1992 | Jacob | 102/301 |
| 5,171,935 | 12/1992 | Michina et al. | 102/275.7 |
| 5,204,492 | 4/1993 | Jacob et al. | 102/275.12 |
| 5,398,611 | 3/1995 | Michna et al. | 102/275.7 |
| 5,499,581 | 3/1996 | Sutula, Jr. | 102/275.12 |

FOREIGN PATENT DOCUMENTS

| | | | |
|---|---|---|---|
| 1203121 | 4/1986 | Canada | 102/275.12 |
| 668932 | 6/1979 | U.S.S.R. | 102/275.7 |
| 2097516 | 11/1982 | United Kingdom | 102/275.7 |
| 2228785 | 9/1990 | United Kingdom | 102/275.7 |

*Primary Examiner*—Michael J. Carone
*Assistant Examiner*—Matthew J. Lattig
*Attorney, Agent, or Firm*—Victor E. Libert; Frederick A. Spaeth

[57] ABSTRACT

A connector device (10) for disposing a detonator (12) in signal transfer relation with a signal-receiving line (30) receives the detonator (12) in a sleeve member (14). A line-engaging member (24) is connected to the sleeve member (14) and cooperates with sleeve member (14) to define a slot (26) therebetween within which the signal-receiving line (30) is disposed. The slot (26) is dimensioned and configured to dispose the signal-receiving line (30) therein in an undulate configuration. The device (10) may be used alone or in conjunction with a tail connector (56) to secure a donor line (74) in signal transfer relation with the input lead (13) of the detonator (12).

8 Claims, 7 Drawing Sheets

SECURE CONNECTOR FOR BLAST INITIATION SIGNAL TRANSFER

BACKGROUND OF THE INVENTION

1. Field of the Invention

This invention relates to connector devices for transferring blast initiation signals between signal transmission lines and, more specifically, to a connector for retaining a detonator disposed at the end of a donor line for emitting an initiation signal in signal transfer relation with an acceptor line for receiving the signal.

2. Related Art

It is common practice in blasting operations to initiate the detonation of one or more charges by transmitting an initiation signal to the charges by means of initiation signal transmission lines. There are various conventional forms of signal transmission lines, e.g., detonating cord, shock tube, low velocity signal tube, etc. Some of these signal transmission lines, particularly shock tube, low velocity signal tube, and low energy detonating cord, carry signals of such low strength that it is often necessary to amplify the signal in order to transfer these signals to another signal transmission line. This is accomplished by using the signal to initiate a detonator disposed in signal transfer relation to the signal-receiving line.

U.S. Pat. No. 5,171,935 to R. Michna et al, dated Dec. 15, 1992, discloses a connector device in which a detonator cap at the end of a donor line is disposed in signal transfer relation with a plurality of signal-receiving shock tube lines. The device includes a body portion having a channel for receiving the detonator cap and a tube-engaging member that defines a straight slot for holding one or more signal transmission tubes in signal transfer relation to the output end of the detonator cap. Since the slot is straight, tubes disposed therein assume a straight, i.e., unbent, configuration within the slot. The tubes are disposed in crosswise relation to the axis of the detonator.

U.S. Pat. No. 4,187,780 to Petruccelli, dated Feb. 12, 1980, discloses a cleat-type connector device for disposing a signal-receiving line in signal transfer relation with a detonator cap. The connector device is principally designed to dispose the signal-receiving portion of the acceptor line in close parallel relation with the detonator cap.

SUMMARY OF THE INVENTION

The present invention relates to a connector device for retaining a non-electric initiation signal acceptor line in signal transfer relation with the output end of a detonator. The device comprises a sleeve member defining a channel for receiving and retaining a detonator therein and having an output end and a line-engaging member connected to the sleeve member. The line-engaging member cooperates with the sleeve member to define therebetween a slot in transverse relation to the channel. The slot is dimensioned and configured to receive an acceptor line therein and to dispose the acceptor line in an undulate configuration.

According to one aspect of the invention, the connector device may comprise an entryway to accommodate lateral insertion of an acceptor line into the slot. Optionally, the line-engaging member and the sleeve member may be dimensioned and configured so that, as an acceptor line is inserted laterally into the slot, it becomes increasingly undulate as it moves from the lateral entryway towards the longitudinal axis of the channel.

In yet another aspect of the invention, the connector device may comprise a movable retainer member. The retainer member may be movable between a line-retaining first position in which it can engage an acceptor line moving laterally within said slot and a line-releasing second position in which it permits lateral insertion and removal of an acceptor line into and from said slot via the entryway. Preferably, the retainer member is biased towards the first position. Optionally, the retainer member may comprise a barb that protrudes into the slot between the longitudinal axis of the channel and the entryway of the slot. The barb may have a shoulder that faces the longitudinal axis and a beveled surface that faces the entryway.

As used herein and in the claims, the term "zig-zag" describes a configuration in which a line or slot has consecutive sharp bends or kinks. The term "undulate" describes a configuration in which there are consecutive bends or kinks that may be smooth, e.g., sinusoidal, or sharp and is intended to encompass zig-zag configurations. The modifier "more" undulate refers to greater numbers of, and/or sharper angles defined by, the kinks or bends in the line, and/or to greater magnitude in the undulations; "less" undulate refers to fewer kinks or bends and/or fewer pointed angles, and/or lesser magnitude in the undulations.

DETAILED DESCRIPTION OF THE INVENTION AND PREFERRED EMBODIMENTS THEREOF

Connector devices in accordance with the present invention facilitate the transfer of non-electric initiation signals and establish a better grip on a line than could be attained with prior art connectors. The superior performance of connector devices in accordance with the present invention is believed to be the result of the establishment of an undulate slot in the device for receiving and retaining the signal-receiving line sometimes referred to herein as an "acceptor line". By establishing an undulate configuration for the acceptor line in the connector device slot, the friction between the acceptor line and the connector device that resists longitudinal movement of the acceptor line through the slot is substantially increased relative to what would be attained by a connector that is conventionally equipped with a straight slot. Accordingly, the acceptor line does not easily slide through the connector device, and this allows for easier handling and more definite determination of the positions of detonators on the acceptor lines. It also obviates the need to tie a knot in the end of an acceptor line to prevent the line from slipping through the device. Further, the detonators are more likely to remain in place on the acceptor line even when the connector or the line on which it is secured is jostled by nearby explosive blasts. The user can therefore plan for the more reliable placement of detonators in the system.

Generally speaking, a connector device in accordance with the present invention comprises a sleeve member having a channel for receiving the detonator. The device also comprises a line-engaging member that is attached to a sleeve member. The line-engaging member and the sleeve member cooperate to define a slot therebetween wherein the signal-receiving line is disposed in an undulate configuration. The undulate configuration is induced by protuberances, e.g., sharp corners or edges, that extend into the slot and produce a kink or bend in the acceptor line.

Figure 1:
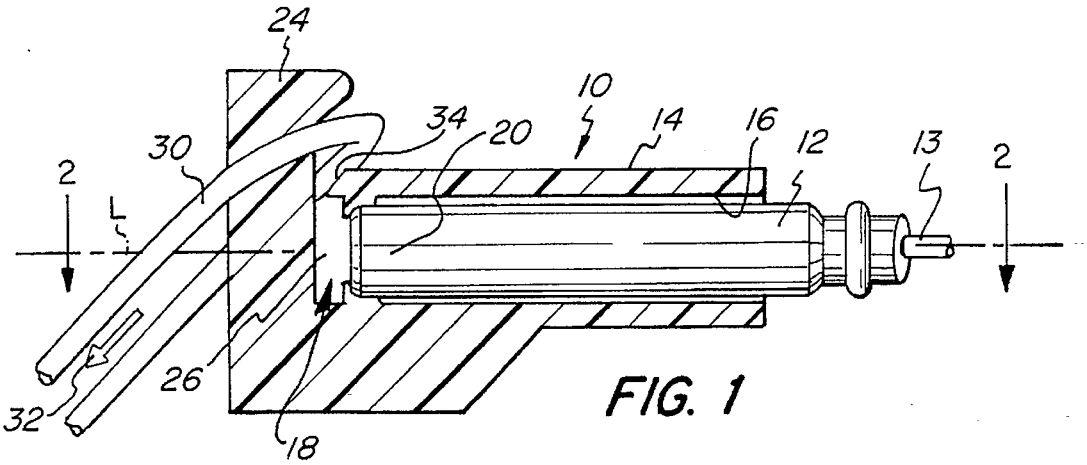
FIG. 1 is a partly cross-sectional elevation view of a connector device in accordance with one embodiment of the present invention having a detonator therein and an acceptor line poised for installation therein.

A connector device 10 in accordance with one embodiment of the present invention is shown in FIG. 1. Connector device 10 comprises a sleeve member 14 that defines a channel 16 within which a detonator 12 is disposed. Detonator 12 is dimensioned for a friction fit in channel 16; FIGS. 1, 2, 3 and 4 show that channel 16 is larger in diameter than detonator 12 only for ease of illustration. An input lead 13 carries an initiation signal from a distal source to detonator 12, which has a signal-emitting end 20 where an output signal is generated in response to the initiation signal. Channel 16 has an output end 18 wherein the signal-emitting end 20 of detonator 12 is disposed. Sleeve member 14 tends to contain the shrapnel produced upon initiation of the detonator 12. A line-engaging member 24 extends from sleeve member 14 and cooperates with the sleeve member to define a slot 26 which traverses channel 16 at its output end 18.

Connector device 10 is seen in FIG. 1 in combination with a signal-receiving (acceptor) line 30 looped around line-engaging member 24. Signal-receiving line 30 is shown in a position favored by users of the device to facilitate insertion of line 30 into slot 26. Typically, connector device 10 is held in one hand while signal-receiving line 30 is looped around line-engaging member 24 and parallel sections thereof are pulled somewhat downward and away from connector device 10 with the other hand. The preferred direction for pulling is approximately a 45° angle with respect to the longitudinal axis L of channel 16, as indicated by arrow 32. As is evident in FIG. 1, sleeve member 14 has a beveled edge 34 that helps guide signal-receiving line 30 into slot 26 and that may contact line-engaging member 24, in which case line-engaging member 24 is resiliently displaceable by virtue of the material of construction of device 10 (typically a polymeric material) and its dimensions and configurations, so that pressure applied on line 30 by the user in the direction of arrow 32 bends line-engaging member 24 away from beveled edge 34 to a degree sufficient to allow acceptor line 30 to pass therebetween and into slot 26. Thus, device 10 provides an entryway that accommodates lateral insertion of an acceptor line into the slot, i.e., that allows an acceptor line to be introduced into the slot by a lateral insertion motion so there is no need to thread one end of line 30 axially through slot 26 in the manner of threading a needle to dispose line 30 in the slot.

Optionally, signal-receiving line 30 is oval in cross section. In such case, the mechanical pinching of signal-receiving line 30 as it passes through the entryway between line-engaging member 24 and beveled edge 34 and the friction between line 30 and the surface of line-engaging member 24 will serve to orient signal-receiving line 30 so that its cross-sectional major axis is perpendicular to the longitudinal axis of the detonator as line 30 enters slot 26, as indicated in FIG. 3.

Figure 2:
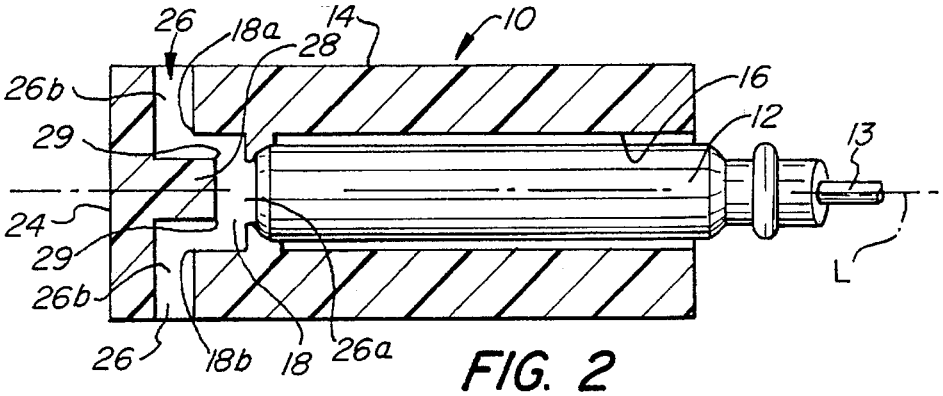
FIG. 2 is a cross-sectional plan view of the device of FIG. 1 taken along line 2—2 of FIG. 1.

It can be seen from FIG. 2 that slot 26 is configured so that a signal-receiving line retained therein will be disposed in a sharply undulate or zig-zag configuration extending across, i.e., transversely of, channel 16 at its output end 18. In particular, line-engaging member 24 comprises a rectangular (in cross section) tooth 28. Tooth 28 protrudes into slot 26 with two sharp edges 29 which, like sharp edges **18*a*, 18*b* of sleeve member 14 bear against a signal-receiving line disposed in the slot. Sharp edges 18*a*, 18*b*, 29 allow connector device 10 to "bite" into a signal-receiving line and securely maintain the line in the slot by causing the line to kink at its points of contact with the sharp edges. The pressure imposed by the sharp edges should not be so severe that it rips or strips the outer jacket of the acceptor line. As seen in FIG. 2, the middle portion 26*a* of slot 26, which traverses channel 16, is configured to dispose a section of an acceptor line therein in close relation to signal-emitting end 20 of detonator 12. Due to the undulate nature of slot 26, the channel-flanking portions 26*b* of slot 26 dispose channel-flanking portions of an acceptor line in axially displaced relation to signal-emitting end 20 of detonator 12**.

Figure 3:
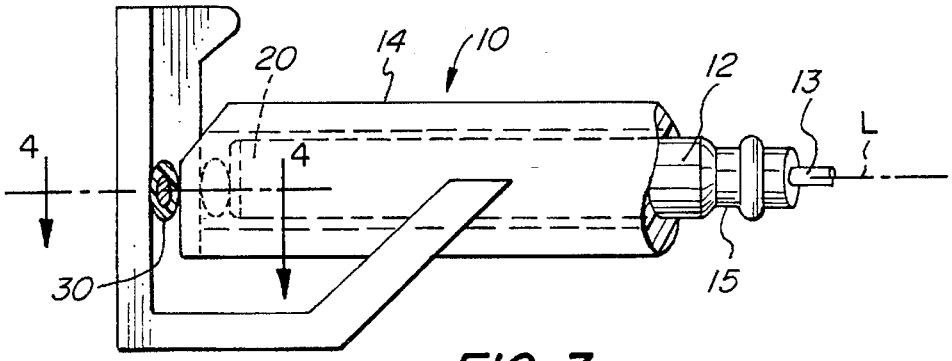
FIG. 3 is an elevation view of the device of FIG. 1 together with the detonator and acceptor line disposed therein.

FIG. 3 provides an elevation view of connector device 10 with signal-receiving line 30 in place. The relative positions of signal-receiving line 30 and signal-emitting end 20 of detonator 12 as they would be in FIG. 2 is indicated in dotted outline in FIG. 3. However, FIG. 3 shows a cross section of a channel-flanking portion of the acceptor line, which is in a position that is axially displaced from signal-emitting end 20 of the detonator as a result of the undulate configuration of line 30.

Figure 4:
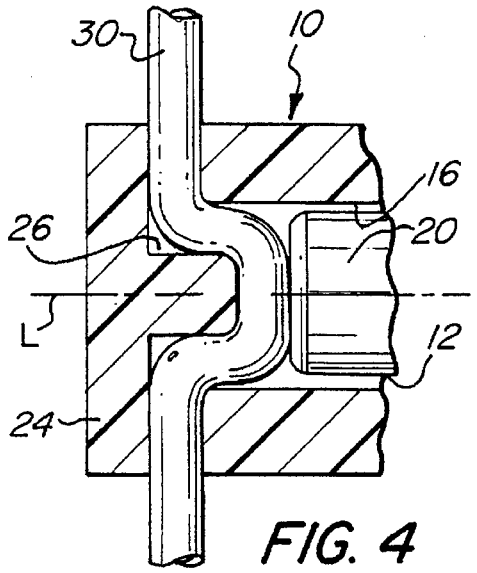
FIG. 4 is a partly cross-sectional plan view of the output end of the device of FIG. 3, taken along line 4—4 of FIG. 3 but on an enlarged scale with respect thereto.

A view of connector device 10, detonator 12 and signal-receiving line 30 of FIG. 3 is illustrated in FIG. 4, where it is easily seen that the sharp edges (**18*a*, 18*b*, 29 shown in FIG. 2) that protrude into slot 26 produce kinks in signal-receiving line 30. Thus, connector device 10 bites into signal-receiving line 30 to provide resistance against slippage along acceptor line 30** in the event that tension in line 30 is encountered. With acceptor line 30 secured in connector device 10, a signal transmitted via input lead 13 initiates detonator 12 and is thereby amplified and transferred to acceptor line 30 due to the juxtaposition of the signal-emitting end 20 of detonator 12 and acceptor line 30 in slot 26.

While the embodiment of FIGS. 1–4 is effective to securely retain a signal-receiving line in the connector device, the kinks produced in the line by the illustrated embodiment can be severe, e.g., requiring that the line assume a ninety degree bend in a small space, and in some cases can damage the line. Accordingly, one aspect of the present invention relates to a connector device that provides an enhanced "grip" on the signal-receiving line without imposing severe kinks in the line. This is accomplished by imposing less severe changes in configuration and compensating for the reduction in stress by providing a greater number of edges that bear against the line. In addition to avoiding damage to the acceptor line, reducing the severity of the kinks facilitates lateral insertion of the acceptor line into the slot.

Figure 5A:
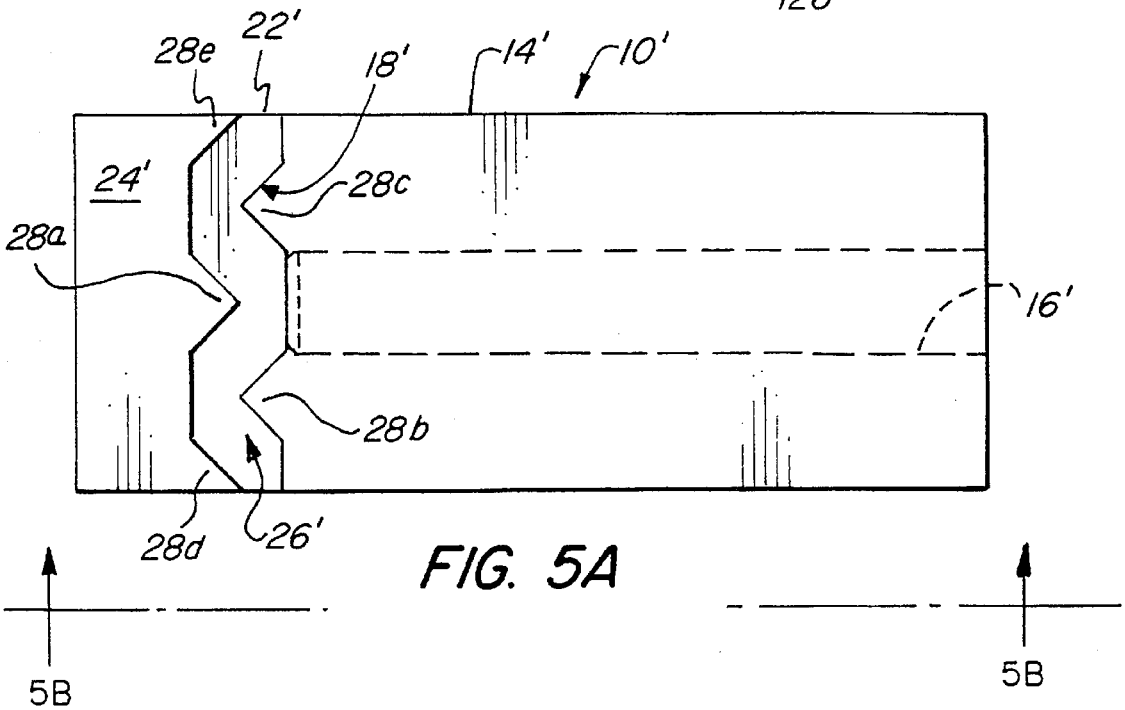
FIG. 5A is a schematic plan view of a connector in accordance with a second embodiment of the present invention.

A connector device in general accordance with a preferred embodiment of the present invention is illustrated in schematic plan view in FIG. 5A. Connector device 10" comprises a sleeve member 14' that defines a channel 16' for receiving a detonator. A line-engaging member 24' is attached to sleeve member 14' by a neck portion 22' and cooperates with sleeve member 14' to define a slot 26' therebetween.

Line-engaging member 24' and sleeve member 14' define three teeth 28*a*, 28*b* and 28*c* that protrude into slot 26', each providing a pointed corner to create a kink in a signal-receiving line disposed in the slot. Lateral teeth 28*d* and 28*e* will also create kinks that bite into an acceptor line if tension is applied to the line. Teeth 28*a*, 28*b* and 28*c* and the width of slot 26' are dimensioned and configured so that the kinks they impose on an acceptor line disposed therein are not as severe as those imposed by tooth 28 of connector device 10 (FIGS. 1–4). For example, at no point in slot 26' would a line be forced into a ninety degree bend. The lack of severity of a given kink and the resulting reduction in gripping force is compensated for by the extended undulate configuration of slot 26', which will induce a sufficient number of kinks in the signal-receiving line to adequately secure the line therein.

Figure 5B:
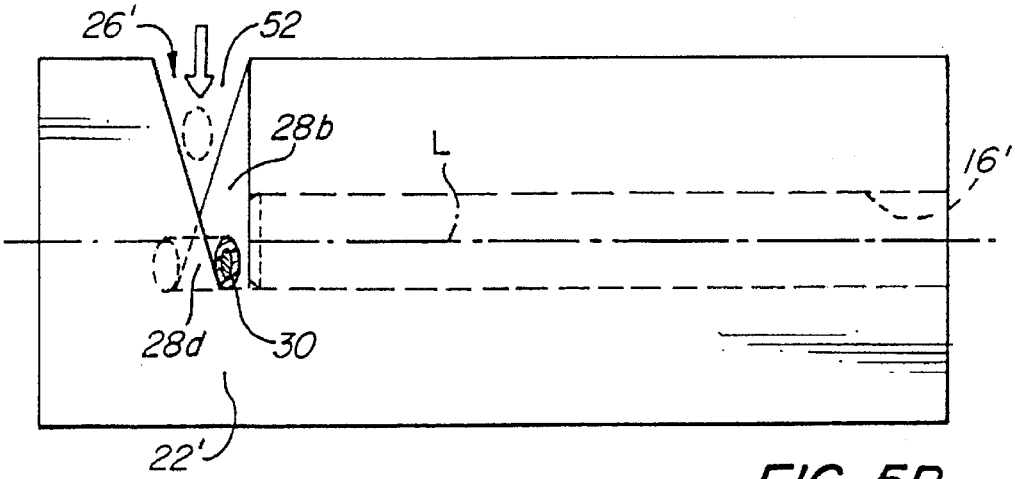
FIG. 5B is a schematic elevation view of the device of FIG. 5A, taken along line 5B—5B.

In FIG. 5B, it can be seen that the edges of the teeth are slanted so that their pointed corners protrude into slot 26' to a lesser degree near entryway 52 than at neck portion 22'. Accordingly, slot 26' is less undulate at entryway 52 and an acceptor line 30 is easily disposed in slot 26' at entryway 52 of slot 26' in a substantially straight configuration. As line 30 moves laterally into slot 26' towards the longitudinal axis L of channel 16', the slanted edges of the teeth bear increasingly on the line because they protrude into the slot more near neck portion 22' than at entryway 52. Accordingly, line 30 becomes increasingly undulate as it moves laterally from entryway 52 into slot 26', as indicated by the lateral motion arrow (unnumbered).

Figure 6B:
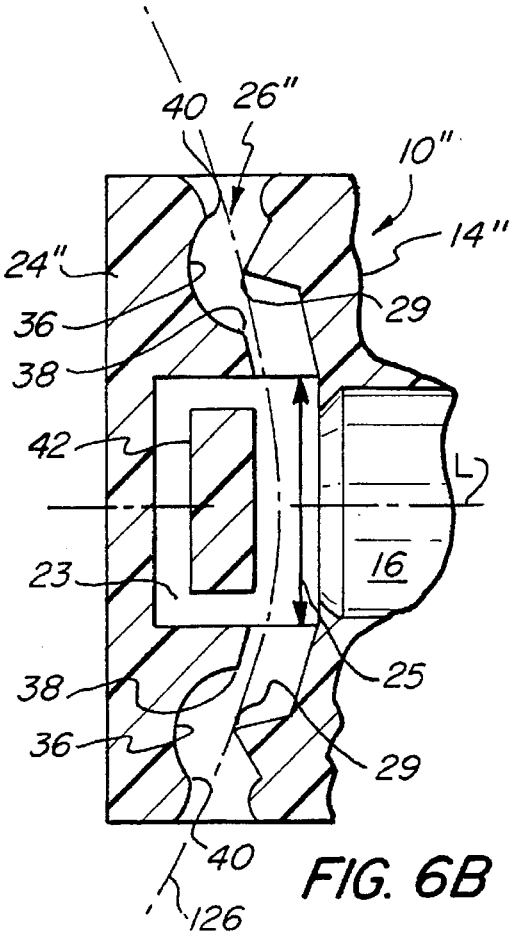
FIG. 6B is an enlarged view of the slot of the connector device of FIG. 6A.
Figure 6A:
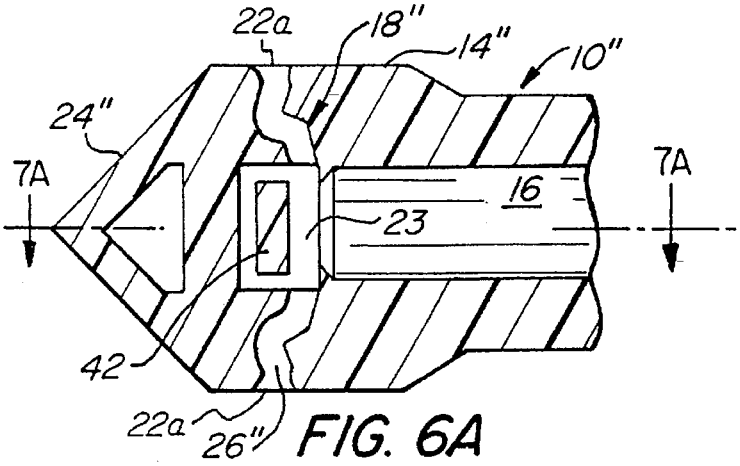
FIG. 6A is a cross-sectional view of a connector device in accordance with yet another embodiment of the present invention.

A particular embodiment of a connector in which the signal-receiving line is disposed in an extended undulate configuration is illustrated in cross-section in FIGS. 6A and 6B. In device 10", line-engaging member 24" is joined to sleeve member 14" by a neck portion 22*a*. Neck portion 22*a* defines an aperture 23 into which a retainer member 42 extends. The structure and function of retainer member 42 is discussed below. Sleeve member 14" and line-engaging member 24" cooperate to define a slot 26" that has an undulate configuration. Slot 26" includes a middle portion 25 (FIG. 6B) that extends across channel 16 and which adjoins aperture 23, as seen in FIG. 7A. Sleeve member 14" defines a pair of teeth (unnumbered) which provide pointed edges 29 (FIG. 6B) to bear against an acceptor line to create a kink in the line. Line-engaging member 24" defines curved recesses 36 positioned opposite from edges 29 to accommodate the convex outer surface of the kinks in the acceptor line that will be formed at edges 29. In addition, line-engaging member 24" defines pairs of protruding edges 38 and 40 which straddle recesses 36. Sleeve member 14" defines recesses (unnumbered) on both sides of edges 29 to complement edges 38 and 40 and to accommodate the kinks caused by edges 38 and 40. Edges 29, 38, and 40 serve to create a total of six kinks in an acceptor line disposed in slot 26". As suggested by dotted arc 126, slot 26" has a generally arcuate configuration that facilitates the lateral insertion therein of a segment of an acceptor line rendered in a loop as suggested in FIG. 1.

Figure 7B:
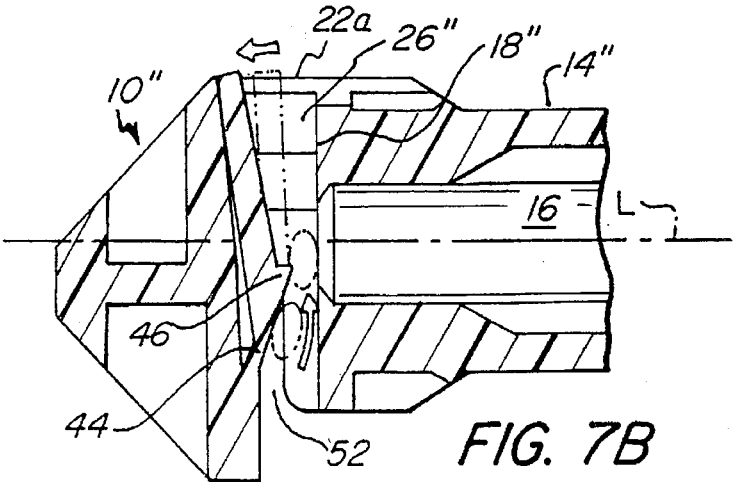
FIG. 7B is a view similar to that of FIG. 7, in which the retainer is shown in a displaced position to permit removal of a line from within the slot.
Figure 7A:
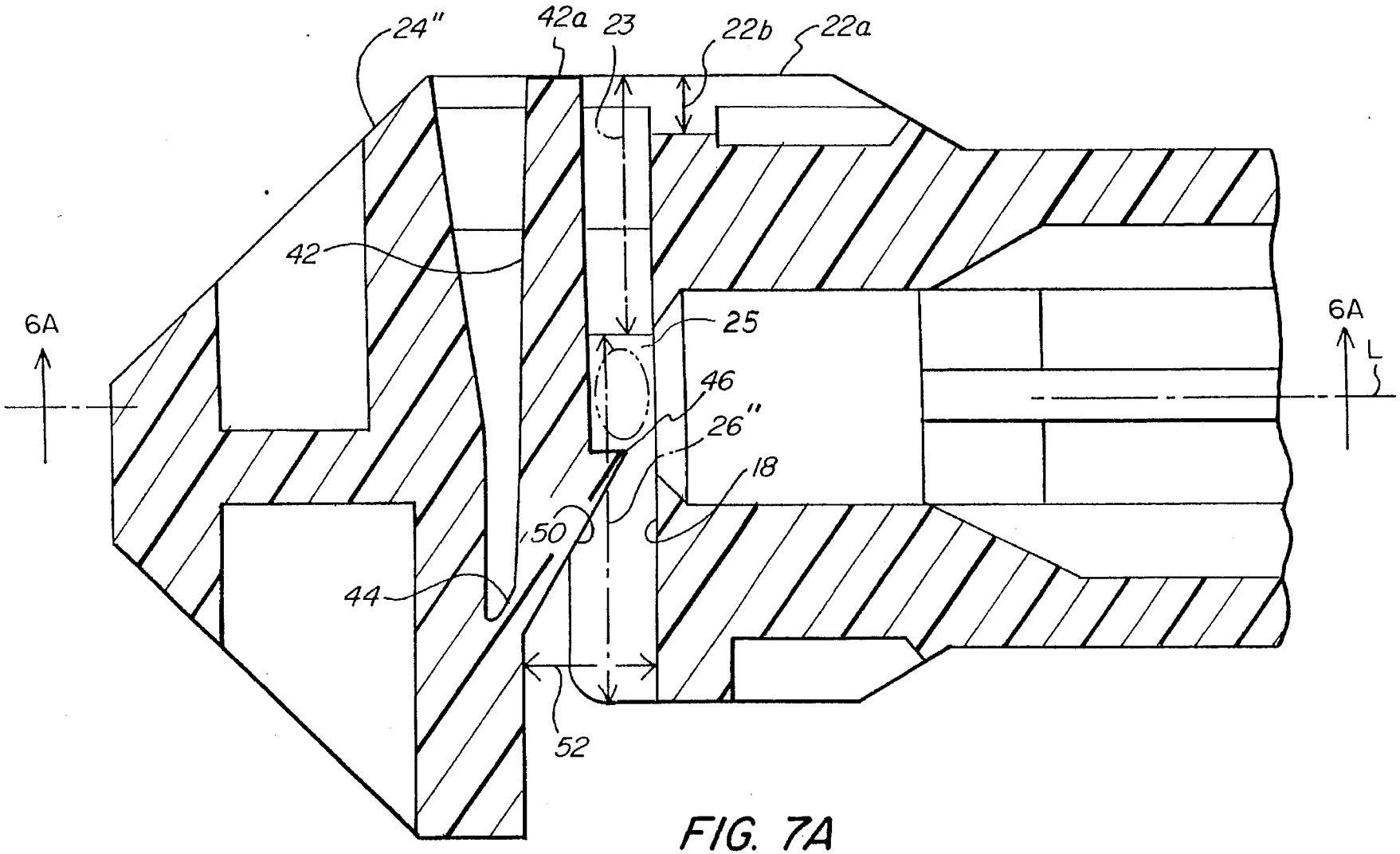
FIG. 7A is a cross-sectional view of the device of FIG. 6A, taken along line 7A—7A showing an acceptor line retainer in the slot.

The structure and function of retainer member 42 is seen more clearly in FIGS. 7A and 7B. As seen in FIG. 7A, retainer member 42 is connected to line-engaging member 24" at a hinge region 44. Hinge region 44 is resilient and tends to dispose retainer member 42 in a first position as illustrated in FIG. 7A, i.e., it biases retainer member 42 towards the first position. Retainer member 42 comprises a barb 46 that protrudes into slot 26" at a point between the longitudinal axis L of channel 16 and lateral slot entryway 52. Barb 46 defines a shoulder 48 that faces the longitudinal axis L of channel 16 so that it provides an obstacle to the lateral escape of a signal-receiving line disposed in slot 26" (as indicated in dotted outline) and thus engages and retains the acceptor line in the slot. Barb 46 also defines a beveled surface 50 disposed towards slot entryway 52. When retainer member 42 is in the first position, surface 50 will engage an acceptor line that moves laterally into slot 26 via entryway 52. Since hinge 44 is flexible and beveled surface 50 is disposed towards entryway 52, a looped portion of a signal-receiving line can be disposed against beveled surface 50 at a point near entryway 52, as suggested in dotted outline in FIG. 7B. Thus, the user may pull the loop taut against retainer member 42, which can swing slightly about hinge region 44 to a second position (shown in FIG. 7B) in which barb 46 no longer obstructs movement of an acceptor line in slot 26". Then, the acceptor line will slip off beveled surface 50 into slot 26" to the position indicated in FIG. 7A. When the acceptor line slips off beveled surface 50, the pressure on retainer member 42 will be relieved and it will spring back to its original position as shown in FIG. 7A due to the action of hinge region 44. The springing action gives the user tactile confirmation that the acceptor line is secured in the slot. Sharp edges and/or recesses formed by sleeve member 14" may be vertically disposed rather than being slanted. The sharp edges and/or recesses formed by the line-retaining member 24" are slanted, however, so that the slot does become increasingly undulate as sensed moving from entryway 52 towards neck region 22*a*, in a manner similar to slot 26' of connector device 10' (FIGS. 5A and 5B).

Figure 7C:
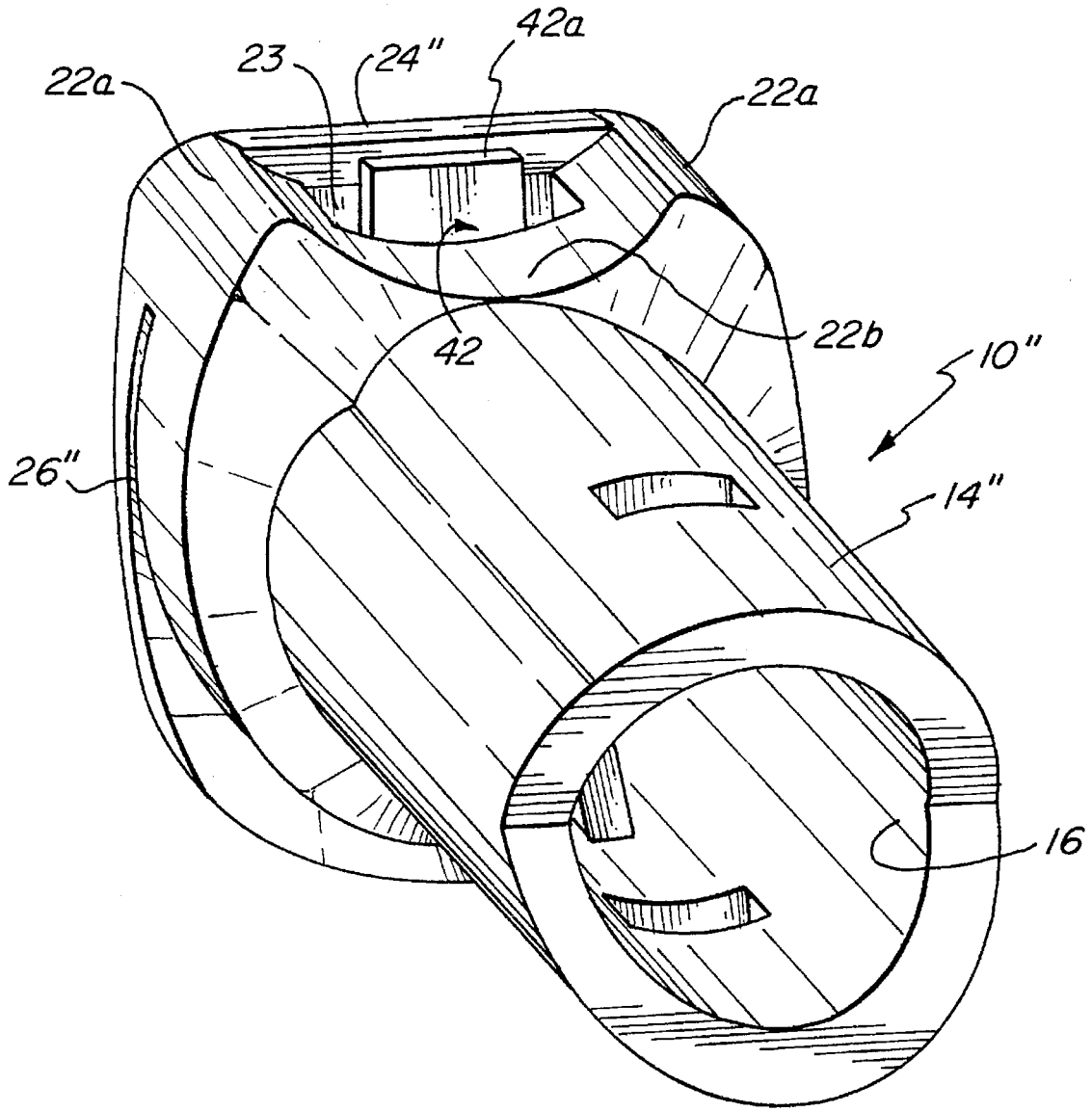
FIG. 7C is an axonometric view of the connector device of FIG. 6A, with the sleeve member foreshortened for ease and clarity of illustration.

Connecting neck region 22*a* defines a neck aperture 23 (FIGS. 6B and 7A) into which retainer member 42 extends. Neck region 22*a* also defines a recess 22*b* (FIGS. 7A and 7C) that exposes end 42*a* of retainer member 42. Preferably, as illustrated in FIG. 7A, end 42*a* of retainer 42 does not extend beyond the cross-sectional profile of neck region 22*a*. However, since end 42*a* is exposed within recess 22*b*, it is accessible to the user, who can apply pressure against end 42*a* to move retainer member 42 from the first position shown in FIG. 7A to the second position shown in FIG. 7B, by pushing end 42*a* towards line-engaging member 24". This moves barb 46 away from the output end 18" of sleeve member 14" to a degree sufficient to allow an acceptor line to be withdrawn from slot 26" through lateral slot entryway 52 in case the acceptor line was mistakenly secured therein.

In alternative embodiments of the invention (not shown), retainer member 42 may be hingedly attached to connector device 10" at a point in slot 26" remote from lateral slot entryway 52, e.g., retainer member 42 may be hingedly attached to neck region 22*a*, and the end of the retainer member may be made accessible to the user at entryway 52.

The detonator 12 may be secured in devices according to the present invention in any conventional manner, for example, by designing sleeve member 14 so that it extends beyond a crimp on the detonator, such as crimp 15 (FIG. 3), and by providing sleeve member 14 with crimp-engaging tabs within bore 16. Such a crimp-engaging arrangement is well-known in the art, as described in U.S. Pat. No. 5,171,935 to Michna et al, dated Dec. 15, 1992, the disclosure of which is hereby incorporated herein by reference, as background information (see positioning cleats 30, 31 in FIG. 1 and column 4, lines 31–35).

Figure 8:
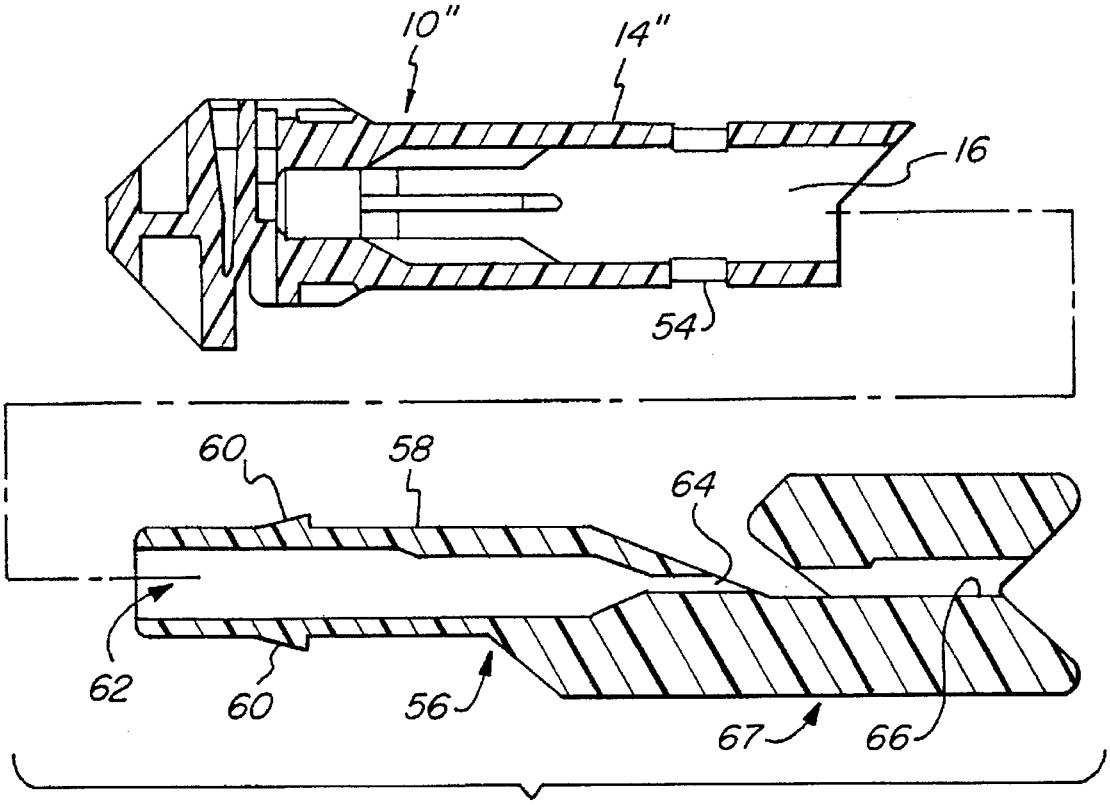
FIG. 8 is an exploded, cross-sectional view of a two-part embodiment of a connector in accordance with the present invention, in which device 10 is dimensioned and configured to engage a tail member.

Optionally, a connector device as described above may be configured to be used as a first part of a two-part connector device. For example, as illustrated in FIG. 8, sleeve member 14" of device 10" can be equipped with slots 54 so that device 10" may be secured to a tail connector 56. Tail connector 56 comprises a tail sleeve 58 which comprises a detonator bore 62 into which a detonator may be inserted. The input lead for the detonator can protrude from lead orifice 64 towards a connector region 67. Tail sleeve 58 comprises tabs 60 and is dimensioned and configured so that it can be inserted into channel 16 of device 10" and so that tabs 60 can engage slots 54 to secure tail connector 56 therein.

Figure 9:
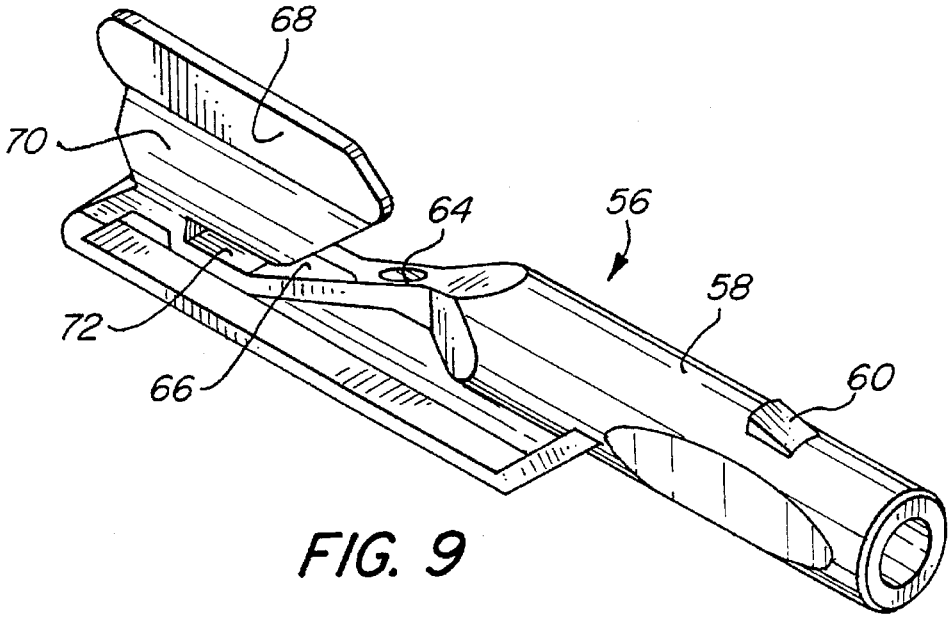
FIG. 9 is a perspective view of the tail member illustrated in FIG. 8.

A perspective view of tail connector 56 is shown in FIG. 9, in which it is seen that lead orifice 64 opens to the surface of anvil member 66 over which is disposed a shroud member 70. Anvil member 66 and shroud member 70 cooperate to define a donor line slot 72.

Figures 10, 11, 12:
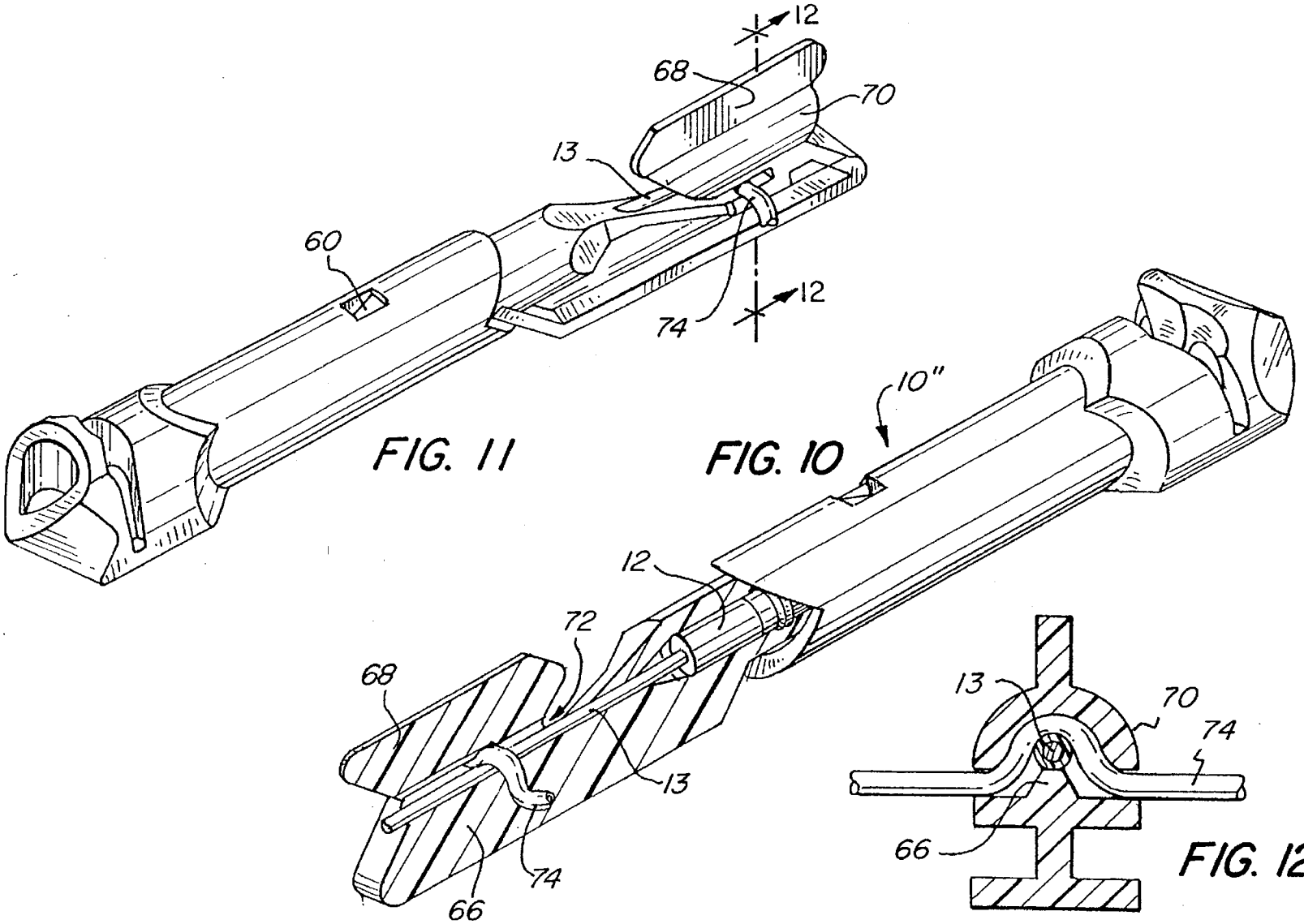
FIG. 10 is a perspective, partly broken away view of the two-part device of FIG. 8 with the parts assembled together, including a detonator and a donor line therein.
FIG. 11 is a full perspective view of the device of FIG. 10.
FIG. 12 is a cross-sectional view of the tail member of FIG. 11 taken at line 12—12.

As illustrated in FIGS. 10, 11 and 12, a donor line 74, which typically comprises detonating cord, can be laterally inserted into donor line slot 72, where shroud member 70 and anvil member 66 will secure donor line 74 in extended, conforming contact with input lead 13 of detonator 12. The partially curved configuration of donor line 74 shown in FIG. 10 establishes extended, conforming contact between the donor line and input lead 13. The curved configuration is imposed by shroud member 70, as can be understood with reference to FIG. 11. By forcing donor line 74 into conforming contact with input lead 13, the reliability of signal transfer between donor line 74 and input lead 13 is improved. (This and other features of this connector are described more fully in co-pending application Ser. No. 08/576,003, filed Jan. 18, 1996, in the name of Lucca et al for "Connector For Blast Initiation system" commonly assigned with the instant application.)

While the invention has been described in detail with reference to particular embodiments thereof, it will be apparent that upon a reading and understanding of the foregoing, numerous alterations to the described embodiments will occur to those skilled in the art and it is intended to include such alterations within the scope of the appended claims.

What is claimed is:

1. A connector device for retaining a non-electric initiation signal acceptor line in signal transfer relation with a detonator having a signal-emitting end, the device comprising:

a sleeve member defining a channel for receiving and retaining such detonator therein, the channel having an output end at which the signal-emitting end of such detonator is disposed; and a line-engaging member cooperating with the sleeve member to define therebetween a slot disposed in transverse relation to the channel, the slot being dimensioned and configured to receive an acceptor line therein and to retain such acceptor line therein by constraining such acceptor line to adopt an undulate configuration within the slot.

2. The connector device of claim 1 comprising an entryway to accommodate lateral insertion of an acceptor line into the slot.

3. The connector device of claim 2 wherein the channel has a longitudinal axis and wherein the line-engaging member and the sleeve member are dimensioned and configured so that as an acceptor line is inserted laterally into the slot, the degree of undulation imposed upon the acceptor line increases as the acceptor line moves from the entryway towards the longitudinal axis of the channel.

4. The connector device of claim 2 further comprising a movable retainer member, the retainer member being movable between a line-retaining first position in which it can engage an acceptor line moving laterally within said slot and a line-releasing second position in which it permits lateral insertion and removal of such acceptor line into and from said slot via the entryway.

5. The connector device of claim 4 wherein the line-engaging member is joined to the sleeve member by a neck portion that defines an aperture, and wherein the retainer member is attached to the sleeve member and extends into the neck portion aperture.

6. The connector device of claim 4 wherein the retainer is biased towards the first position.

7. The connector device of claim 4 or claim 6 wherein the channel has a longitudinal axis and wherein the retainer member comprises a barb that protrudes into the slot between the longitudinal axis of the channel and the slot entryway, the barb having a shoulder that faces the longitudinal axis of the channel and having a beveled surface that faces towards the entryway.

8. The connector device of claim 7 wherein the line-engaging member is joined to the sleeve member by a neck portion that defines an aperture, and wherein the retainer member is attached to the sleeve member and extends into the neck portion aperture.

* * * * *

UNITED STATES PATENT AND TRADEMARK OFFICE

CERTIFICATE OF CORRECTION

PATENT NO. : 5,659,149

DATED : August 19, 1997

INVENTOR(S) : Daniel P. Sutula, Jr.

It is certified that error appears in the above-indentified patent and that said Letters Patent is hereby corrected as shown below:

In column 5, line 24, replace 10 double-prime (10") with 10 single-prime --10'--.

In column 7, line 58, replace "system" with --System--.

Signed and Sealed this

Thirty-first Day of March, 1998

*Attest:*

*Attesting Officer*

BRUCE LEHMAN

*Commissioner of Patents and Trademarks*